US005156492A

United States Patent [19]

Nojima

[11] Patent Number: 5,156,492

[45] Date of Patent: Oct. 20, 1992

[54] UNDERWATER SWIMMING APPARATUS

[75] Inventor: Youko Nojima, Kagoshima, Japan

[73] Assignee: Yuugen Kaisha Parasight, Chiba, Japan

[21] Appl. No.: 465,231

[22] PCT Filed: Sep. 12, 1988

[86] PCT No.: PCT/JP88/00926

§ 371 Date: Mar. 13, 1990

§ 102(e) Date: Mar. 13, 1990

[87] PCT Pub. No.: WO89/02849

PCT Pub. Date: Apr. 6, 1989

[30] Foreign Application Priority Data

Sep. 24, 1987 [JP] Japan ..... 62-240375

[51] Int. Cl.[5] ..... B63C 11/10

[52] U.S. Cl. ..... 405/189; 405/185; 405/186

[58] Field of Search ..... 405/185, 187, 188, 189, 405/190, 191, 192, 193, 194; 114/326, 312, 314, 322, 324, 323, 315

[56] References Cited

U.S. PATENT DOCUMENTS

| | | | |
|---|---|---|---|
| 738,206 | 9/1903 | Lake | 405/192 |
| 1,223,515 | 4/1917 | Papanastasiou | 405/193 X |
| 3,344,614 | 10/1967 | Byck | 405/193 |
| 3,379,022 | 4/1968 | Welton | 405/193 |
| 3,516,489 | 6/1970 | Jergins | 405/185 |

FOREIGN PATENT DOCUMENTS

| | | | |
|---|---|---|---|
| 2361505 | 4/1978 | France | 405/188 |
| 120102 | 10/1918 | United Kingdom | 405/189 |

*Primary Examiner*—Dennis L. Taylor

*Attorney, Agent, or Firm*—Jordan and Hamburg

[57] ABSTRACT

A plurality of containers are combined in a stepped manner into a container group. Each container opens downwardly. They are sunk under water and anchored to the bed of the sea. A notch is formed at a lower portion of a side wall of each container connected to the next container so as to permit air to pass therethrough. Air is supplied into the interior of the lowermost container. The air is delivered to upper containers one after another through the notches and accumulated in all interiors of the containers. A staircase is disposed in a position spaced from the container group by a predetermined distance. A diver can use the space between the staircase and the container group. Furthermore, a diver can step down from the uppermost container to the lower ones one after another, so that he can also get deep into the sea without any scuba equipment or air accumulator.

6 Claims, 2 Drawing Sheets

UNDERWATER SWIMMING APPARATUS

FIELD OF THE INVENTION

The present invention relates to an underwater swimming apparatus and, in particular, to an underwater swimming apparatus which makes it possible to freely swim underwater without scuba equipment or the like.

BACKGROUND OF THE INVENTION

Diving without any scuba equipment is restricted to short time periods during which people can hold their breath.

Diving using scuba equipment makes it possible to swim underwater for a long time. However, diving with scuba equipment requires much training and experience. Therefore, it is hard for people in general to dive or swim with scuba equipment. Therefore, in order to swim underwater or to obtain living space underwater, for example, a station or a dome is constructed underwater, and the interior of the dome is used as a living space. Further, Japanese Utility Model Unexamined Publication No. 49-17000 discloses an apparatus which can make it possible to swim and to behave in a desired manner in an underwater dome. The apparatus includes means for supporting the dome at a desired depth in the sea, a gate through which users can come into and go out from the dome, and means for supplying air of a pressure higher than the water pressure at such depth. However, such apparatus has a complicated construction and no known apparatus has been proposed yet which can easily and readily provide people with living space underwater.

SUMMARY OF THE INVENTION

An underwater swimming apparatus according to the present invention comprises a group of containers connected at a side wall thereof to each other in a stepped manner. Each of the containers opens downwardly, and notch means are provided at a lower portion of the side wall of each container to be connected to the next container. Means are provided for pumping air into a lowermost one of the containers, and means for supporting the containers are provided parallel to and spaced from the containers. Also means for anchoring the containers and the supporting means under water are provided. Air pumped from the pumping means remains in the space defined by the containers. Therefore, people can swim in the space without scuba equipment or the like.

BRIEF DESCRIPTION OF THE DRAWINGS

The present invention will be explained in detail hereinafter with reference to the accompanying drawings.

DESCRIPTION OF THE PREFERRED EMBODIMENTS

Figure 1:
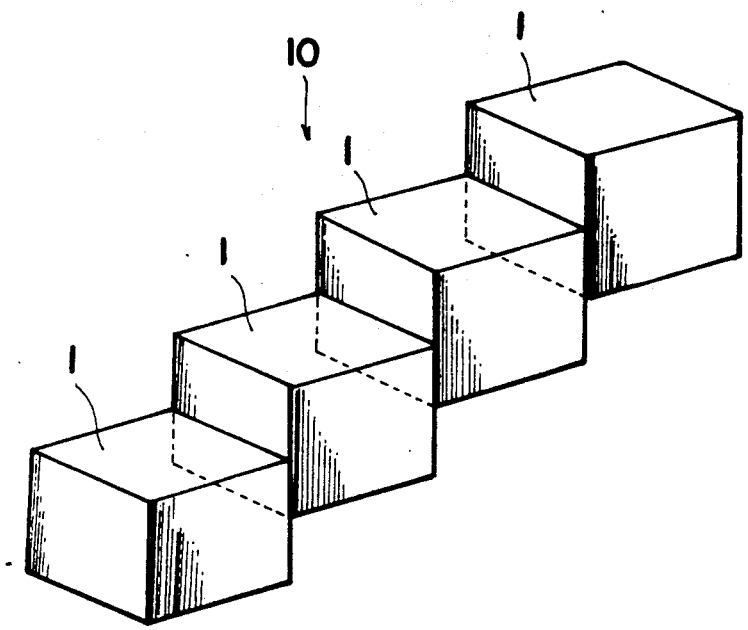
FIG. 1 is a perspective view showing an arrangement of the containers constituting an underwater swimming apparatus shown in FIG. 2.
Figure 2:
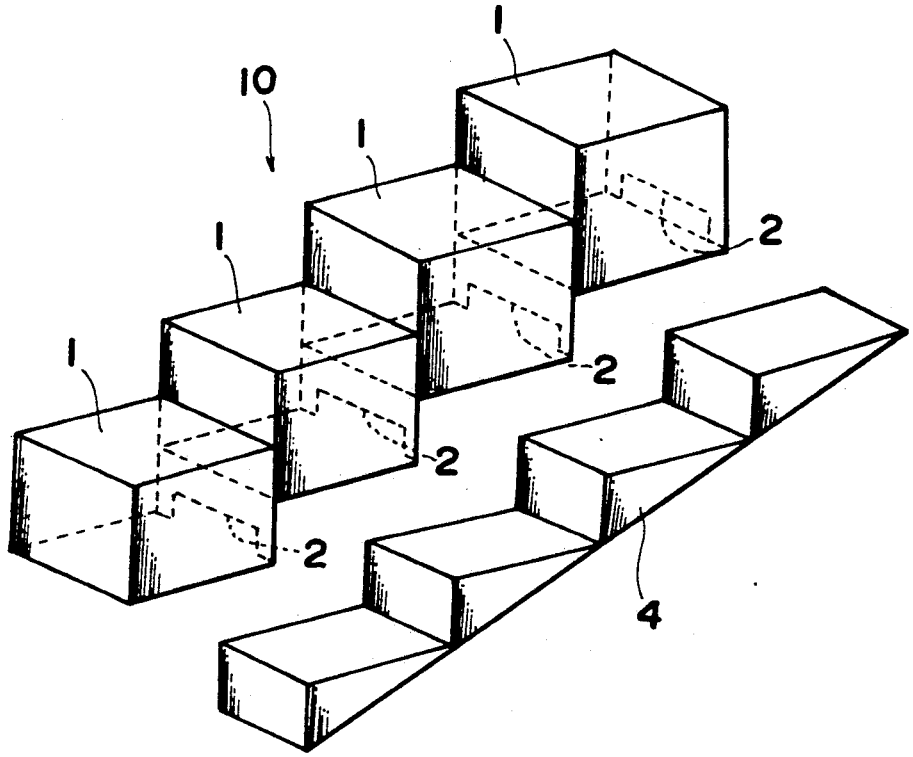
FIG. 2 is a perspective view showing the underwater swimming apparatus according to one embodiment of the present invention.
Figure 3:
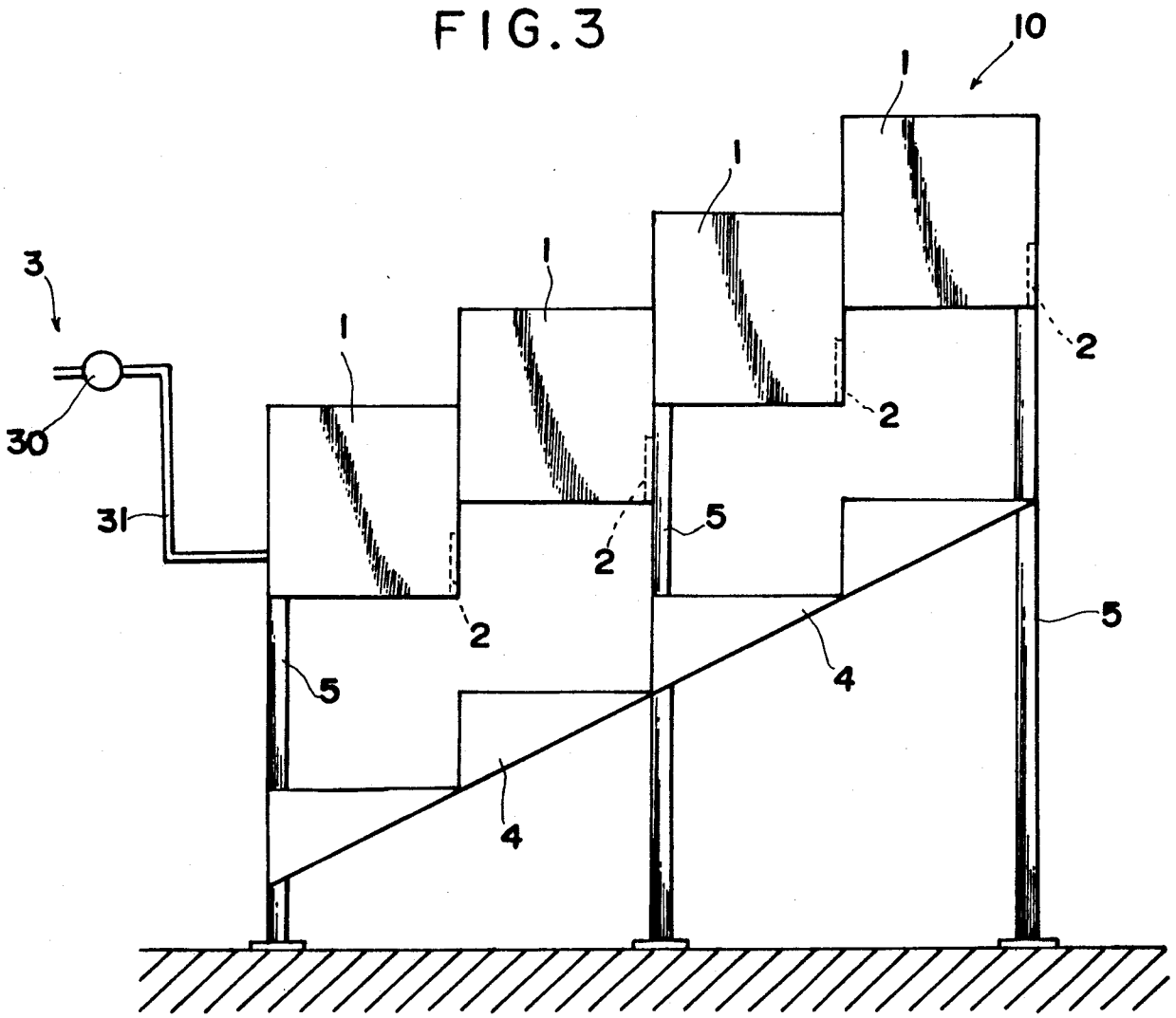
FIG. 3 is a side view showing a space in which people can swim.

In the drawings, reference numeral 1 designates a cubic container, the bottom of which is opened. A plurality of containers 1 are connected to each other in a stepped manner so as to provide a group of containers 10 as shown in FIG. 1. Namely, the containers 1 are integrated into a container group 10 in which the containers are disposed in a stepped arrangement and connected at one side wall thereof to each other. Reference numeral 2 designates a notch formed at a lower portion of a side wall of each container 1. The lower portion is not connected to the next container, but the rest of the side wall is connected to the next one. Reference numeral 3 generally designates an air supply means communicating with the lowermost container 1. The air supply means 30 includes a compressor for pumping compressed air into the lowermost container 1 and a hose communicating at one end thereof with the compressor and at the other end thereof with the lowermost container 1. Reference numeral 4 designates a staircase disposed parallel to the container group 10. The staircase 4 is used as container supporting means and is spaced by a predetermined distance from the container group 10 through coupling members (not shown in FIG. 2) provided between the containers 1 and the staircase 4. Reference numeral 5 designates anchor means for anchoring the container group 10 and the staircase 4 under water. The anchor means 5 includes posts each of which is secured at a base end portion thereof on the bed of the sea and is connected at a distal end portion thereof to the container group 10 and the staircase 4 thereby anchoring them under water.

Operation of the apparatus constructed as above will now be described.

Firstly, the compressor is operated to pump air of a predetermined pressure level into the lowermost container 1. Air introduced into the lowermost container 1 passes through the notch into the next upper container 1 and then to a further upper container 1, one after another. Finally, the interior of all containers 1 is filled with air. Accordingly, a lower space of the container group 10 defines a living space filled with air in which people can swim. In the illustrated embodiment, since the staircase 4 is disposed at a predetermined spacing from the container group 10 and air is accumulated in the space defined within the containers of the container group 10, people can swim or otherwise use the area. The staircase 4 of the shown shape permits people to use the staircase 4, e.g., for standing up, sitting or the like. Furthermore, a diver can step down from the uppermost container 1 to the lower ones, one after another, so that he can thereby proceed to the deep sea without any scuba equipment or other air accumulator.

According to the present invention, there is provided an underwater swimming apparatus which is simple in construction and which can readily and safely provide a living space under water. Accordingly, the present invention is highly applicable for ocean leisure.

What is claimed is:

1. An underwater apparatus comprising a connected group of containers consisting of a group of individual containers each having side walls which are connected to one another in a stepped manner such that said connected group of containers are disposed in stepped array, said connected side walls having a lower portion formed with notch means, air supply means for pumping air into the lowermost individual container of said connected group of containers such that the air pumped into said lowermost individual container fills said lowermost individual container and then passes through the associated notch means into the next individual container to fill said next individual container and then passes through the associated notch means to fill the subsequent individual container and thereafter passes in like manner to fill all of the individual containers of said connected group of containers, support means underlying and spaced from said connected group of containers, and means for anchoring said connected group of containers and said support means in a submerged position underwater.

2. An underwater apparatus according to claim 1, wherein said support means comprises a plurality of step-like structures connected in stepped array and arranged such that a step-like structure underlies each of said individual containers of said connected group of containers.

3. An underwater apparatus according to claim 1, wherein said support means has a step-like configuration and said support means and said group of connected containers are arranged in parallel stepped array.

4. An underwater apparatus according to claim 1, wherein each of said individual containers has a top and a bottom with said tops being disposed in stepped array and said bottoms also being disposed in stepped array.

5. An underwater apparatus according to claim 1, wherein each of said individual containers has a front side wall and a rear side wall, each of said front side walls being disposed opposite to a respective rear side wall, each of said rear side walls and front side walls having an upper section and a lower section with the upper section of each rear side wall being connected to the lower section of the front side wall of the next connected individual container.

6. An underwater apparatus according to claim 5, wherein each front side wall has a lower edge coincident with the bottom of the respective individual container, said lower edge being at a higher elevation than the elevation of the notch means in the rear side wall which is connected to the respective front side wall.

* * * * *